US010041762B2

(12) United States Patent
Zhang

(10) Patent No.: US 10,041,762 B2
(45) Date of Patent: Aug. 7, 2018

(54) HOLSTER WITH PROTECTION MECHANISM FACILITATING HOLSTERING AND UNHOLSTERING AND PROTECTING AGAINST THEFT AND ROBBERY

(71) Applicant: Joe Zhang, Shenzhen (CN)

(72) Inventor: Joe Zhang, Shenzhen (CN)

(73) Assignee: CYTAC TECHNOLOGY LIMITED, Shenzhen (CN)

( * ) Notice: Subject to any disclaimer, the term of this patent is extended or adjusted under 35 U.S.C. 154(b) by 0 days.

(21) Appl. No.: 15/445,216

(22) Filed: Feb. 28, 2017

(65) Prior Publication Data

US 2018/0188002 A1 Jul. 5, 2018

(30) Foreign Application Priority Data

Jan. 5, 2017 (CN) ..... 2017 1 0006668

(51) Int. Cl.
*F41C 33/02* (2006.01)

(52) U.S. Cl.
CPC ..... *F41C 33/0272* (2013.01); *F41C 33/0236* (2013.01); *F41C 33/0263* (2013.01)

(58) Field of Classification Search
CPC ..... F41C 33/0263; F41C 33/0236; F41C 33/0272
USPC ..... 224/244, 245, 240, 912
See application file for complete search history.

(56) References Cited

U.S. PATENT DOCUMENTS 3,550,822 A * 12/1970 Lloyd ..... F41C 33/0245 224/193
5,501,381 A * 3/1996 Rogers ..... F41C 33/0227 224/196
5,551,611 A * 9/1996 Gilmore ..... A45F 5/00 224/192
5,630,535 A * 5/1997 Valenti ..... A45F 5/02 224/191
5,944,239 A * 8/1999 Rogers ..... F41C 33/0209 224/193
6,112,962 A * 9/2000 Matthews ..... F41C 33/0236 224/191
6,604,657 B2 * 8/2003 Yirmiyahu ..... F41C 33/0227 224/243
7,461,765 B2 * 12/2008 French ..... F41C 33/0227 224/238

(Continued)

FOREIGN PATENT DOCUMENTS

CN 200720008125.4 8/2008
CN 201410211632.2 7/2014

*Primary Examiner* — Brian D Nash
(74) *Attorney, Agent, or Firm* — Getech Law LLC

(57) ABSTRACT

The present invention discloses a holster with a protection mechanism that facilitates holstering and unholstering and protects against theft and robbery, comprising: a waist protection plate, a holster body, a positioning supporting plate, an L-shaped connecting piece, and a positioning supporting clamp. A pressing member is disposed at a side close to the waist protection plate. A positioning column fixes and tightly locks the L-shaped connecting piece with the holster body by inserting gaskets and an E-shaped washer into a clamping slot. The L-shaped connecting piece and the positioning supporting clamp cooperate with each other in space according to a lever principle, and an overall trigger mechanical structure is simple, low in failure rate and relatively reliable in actual applications.

9 Claims, 4 Drawing Sheets

(56) References Cited

U.S. PATENT DOCUMENTS

| | | | | |
|---|---|---|---|---|
| 7,556,181 | B2 * | 7/2009 | Spielberger | F41C 33/0245 224/243 |
| 7,922,050 | B2 * | 4/2011 | Beneš | F41C 33/0227 224/192 |
| 8,602,275 | B1 * | 12/2013 | Kiger | F41C 33/0263 224/238 |
| 8,646,665 | B2 * | 2/2014 | Abushaev | F41C 33/0281 224/243 |
| 8,807,404 | B1 * | 8/2014 | Howell | F41C 33/0263 224/242 |
| 8,851,344 | B2 * | 10/2014 | Baumann | F41C 33/0263 224/192 |
| 8,910,839 | B2 * | 12/2014 | Clifton | F41C 33/0209 224/192 |
| 9,022,262 | B2 * | 5/2015 | Pellegrini | F41C 33/0227 224/193 |
| 9,664,480 | B2 * | 5/2017 | Faifer | F41C 33/0209 |
| 9,759,515 | B2 * | 9/2017 | Yeates | F41C 33/0227 |
| 2004/0251284 | A1 * | 12/2004 | Pelligrini | A45F 5/02 224/198 |
| 2007/0181619 | A1 * | 8/2007 | Seyfert | F41C 33/0227 224/196 |
| 2009/0321480 | A1 * | 12/2009 | Kincaid | F41C 33/0227 224/243 |
| 2010/0252591 | A1 * | 10/2010 | Lu | F41C 33/0263 224/243 |

* cited by examiner

HOLSTER WITH PROTECTION MECHANISM FACILITATING HOLSTERING AND UNHOLSTERING AND PROTECTING AGAINST THEFT AND ROBBERY

FIELD OF THE INVENTION

The present invention relates to the technical field of holsters, and in particular, to a holster with a protection mechanism that facilitates holstering and unholstering and protects against theft and robbery.

BACKGROUND OF THE INVENTION

An existing holster generally consists of a pouch and a waist belt fastener, and in order to prevent a gun from falling out, the holster is generally provided with a pouch buckle to buckle the gun into the pouch. This holster is liable to cause accidental firing or vulnerable to robbery and the gun cannot be drawn quickly, thus causing huge life danger to law enforcement officers; and meanwhile, the law enforcement officers cannot stop crimes in time and have a poor self-defense ability, which increases their working pressure and mental stress.

A brake-type anti-robbery fast-draw holster disclosed in Patent No. CN200720008125.4 includes a belt sheath, a holster assembly disposed on the belt sheath, a connection ring disposed between the belt sheath and the holster assembly, a brake buckling device disposed on the holster assembly, an angle adjustment device disposed on the holster assembly, and a safety device disposed on the holster assembly, wherein multiple safety devices are disposed to prevent accidental firing of a gun. An anti-robbery fast-draw holster disclosed in Patent No. CN201410211632.2 includes a rear cover assembly, a holster assembly disposed on the rear cover assembly, a machine core assembly disposed on the holster assembly, left and right brake buckling assemblies disposed on the holster assembly, an ejection lock assembly disposed in the holster assembly, and a safety lock assembly disposed at an upper end of the holster assembly, wherein the holster innovatively employs magnetic power and is not restricted by environmental conditions. However, the prior art still has the following disadvantages: the structure is complex; the failure rate is high; a gun is generally drawn by pressing a trigger locking button with an index finger, and therefore may be clamped when drawn quickly; and there are also certain defects in protecting against theft and robbery, i.e. the locking button is easily touched during theft and robbery.

SUMMARY OF THE INVENTION

An objective of the present invention is to solve at least the foregoing problem and provide at least the advantages that will be described hereinafter.

Another objective of the present invention is to provide a holster with a protection mechanism that facilitates holstering and unholstering and protects against theft and robbery, which is simple in structure, low in failure rate and relatively reliable in actual applications, protects against theft and robbery, provides reliable protection, and enables a gun to be drawn quickly, so as to solve the problem discussed in the background.

To achieve the foregoing objectives, the present invention provides the following technical solution: a holster with a protection mechanism that facilitates holstering and unholstering and protects against theft and robbery comprises: a waist protection plate, a holster body disposed at one side of the waist protection plate, a positioning supporting plate disposed above the holster body and at a side close to the waist protection plate, an L-shaped connecting piece disposed above the positioning supporting plate, and a positioning supporting clamp disposed at one side of the positioning supporting plate.

Preferably, an overall structure of the waist protection plate is a cambered surface, two fastener link platforms are arranged above the waist protection plate, positioning bosses are arranged at both sides of a middle part of the waist protection plate, an outer side of the positioning boss and an outer side of the fastener link platform are disposed in the same vertical plane, a bolt hole is opened at a middle part of the fastener link platform, a primary screw is connected inside the bolt hole, and the waist protection plate is fastened with the holster body via the primary screw.

Preferably, the holster body is a cavity structure matching a gun, a fixing platform in pressing connection for unholstering is disposed at a middle part of a lateral side of the holster body, decorative lines are arranged at a periphery of a lower part of the holster body, several secondary screws are connected at one side of the holster body, and the holster body is fastened with the positioning supporting plate via the secondary screws.

Preferably, a positioning column is fixedly disposed at one side of an upper part of the positioning supporting plate, the positioning supporting plate is hinged with the L-shaped connecting piece through the positioning column, a clamping slot is arranged at a top end of the positioning column, an E-shaped washer rotatable around the clamping slot is connected to the positioning column through the clamping slot, and gaskets are disposed between the positioning column and the L-shaped connecting piece and between the E-shaped washer and the L-shaped connecting piece.

Preferably, a pin is fixedly disposed at one side below the positioning supporting plate, the positioning supporting plate is hinged with the positioning supporting clamp via the pin, and a return spring is mounted between the positioning supporting clamp and the positioning supporting plate.

Preferably, a pressing member is arranged at a top end of the L-shaped connecting piece, a supporting block matching a top end of the positioning supporting clamp is disposed at a bottom end of the L-shaped connecting piece, and the L-shaped connecting piece and the positioning supporting clamp cooperate with each other in space according to a lever principle.

Preferably, anti-skid bumps in rectangular arrangement are uniformly arranged on an upper surface of the pressing member, the pressing member is of an upward protruding structure, and the upper surface of the pressing member has an area of 2-5 $cm^2$.

Preferably, a main body of the pressing member matches an upper edge of the waist protection plate, and the pressing member employs a transverse pressing mode.

Preferably, the position of the positioning supporting clamp corresponds to the position of a trigger guard ring after a gun is placed in the holster body.

The present invention has at least the following beneficial effects: the pressing member is disposed at a side close to the waist protection plate and therefore not easily touched by an external force, thus preventing a gun from missing, theft or robbery, and providing reliable protection; the positioning column fixes and tightly locks the L-shaped connecting piece with the holster body by inserting the gaskets and the E-shaped washer into the clamping slot; the L-shaped connecting piece and the positioning supporting clamp cooperate with each other in space according to a lever principle, and an overall trigger mechanical structure is simple, low in failure rate and relatively reliable in actual applications; and the triggering mode of pressing and pushing the pressing member with a thumb can be simultaneously performed with the action of unholstering, thus improving the speed of unholstering, such that the gun can be drawn quickly.

Other advantages, objectives and features of the present invention will be partially embodied through the following description, and partially understood by persons skilled in the art through study and practice of the present invention.

In the figures: 1, waist protection plate; 2, holster body; 3, positioning supporting plate; 4, L-shaped connecting piece; 5, positioning supporting clamp; 6, fastener link platform; 7, positioning boss; 8, bolt hole; 9, primary screw; 10, fixing platform; 11, decorative line; 12, secondary screw; 13, positioning column; 14, clamping slot; 15, E-shaped washer; 16, gasket; 17, pin; 18, return spring; 19, pressing member; 20, supporting block; 21, anti-skid bumps.

DETAILED DESCRIPTION OF THE INVENTION

The technical solutions in the embodiments of the present invention will be clearly and completely described below with reference to the accompanying drawings in the embodiments of the present invention. Apparently, the described embodiments are merely a part rather than all of the embodiments of the present invention. All the other embodiments obtained by persons of ordinary skill in the art based on the embodiments of the present invention without creative efforts shall fall within the protection scope of the present invention.

It should be understood that, terms such as "have", "include", and "comprise" used herein do not exclude the presence or addition of one or more other elements or a combination thereof.

Figure 1:
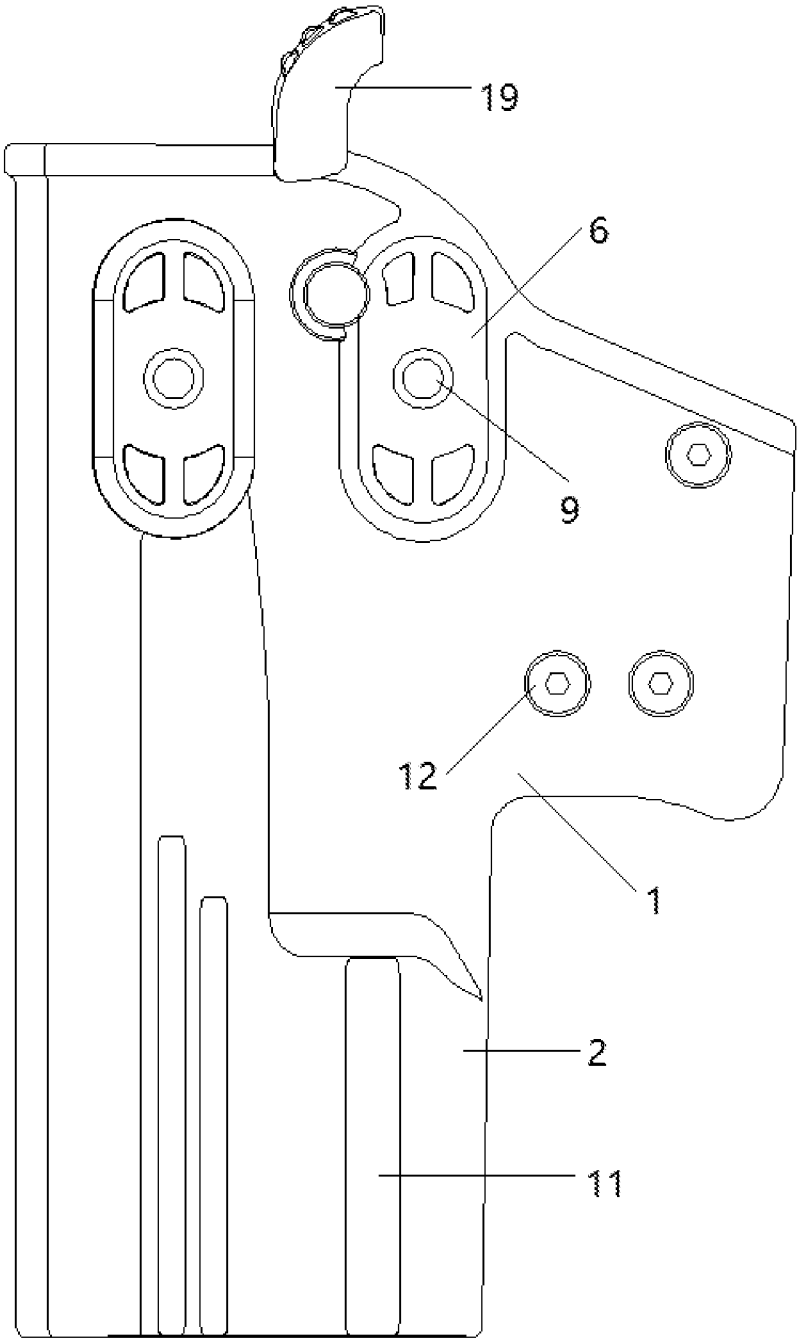
FIG. 1 is a left view of the present invention.
Figure 2:
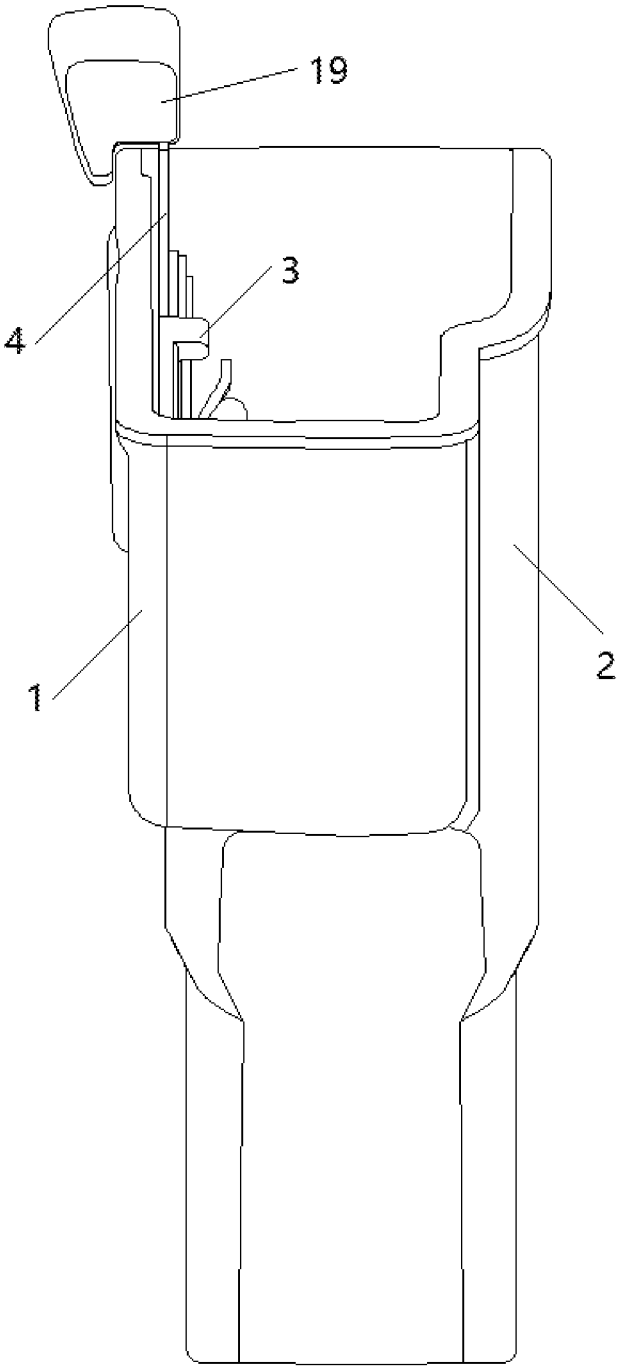
FIG. 2 is a front view of the present invention.
Figure 3:
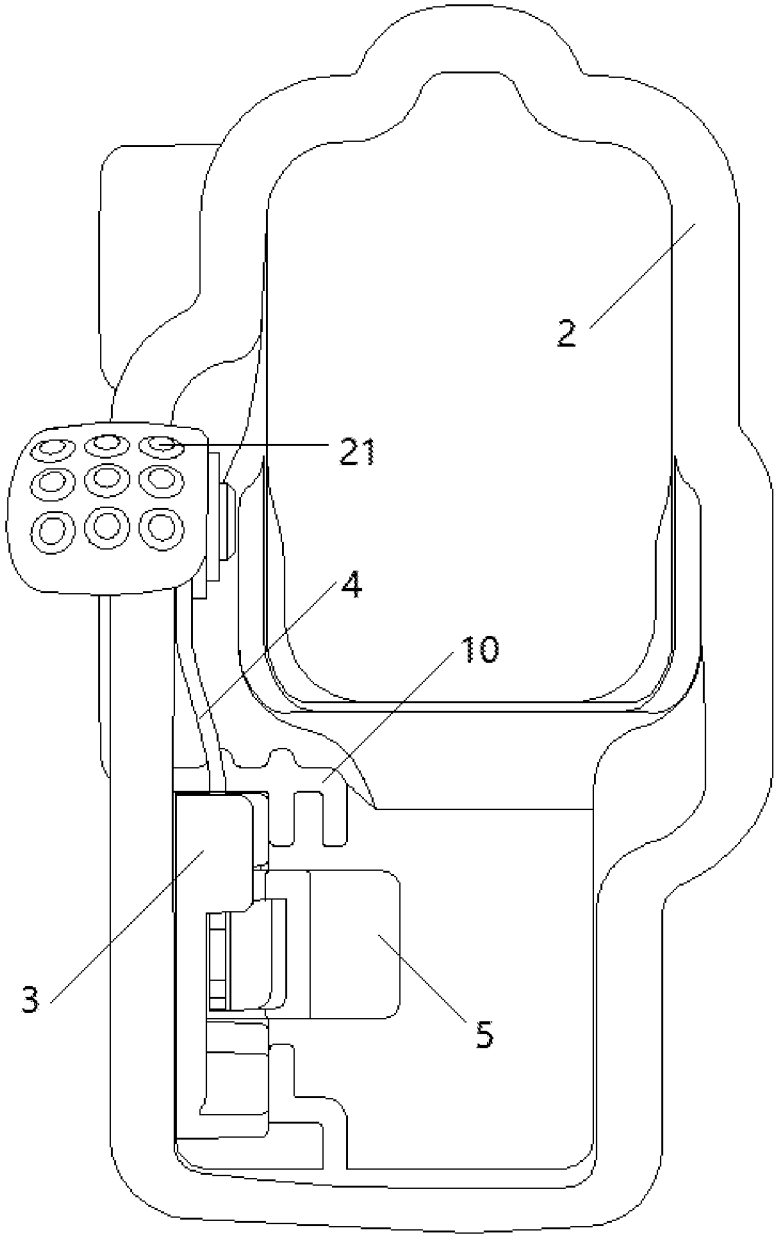
FIG. 3 is a top view of the present invention.
Figure 4:
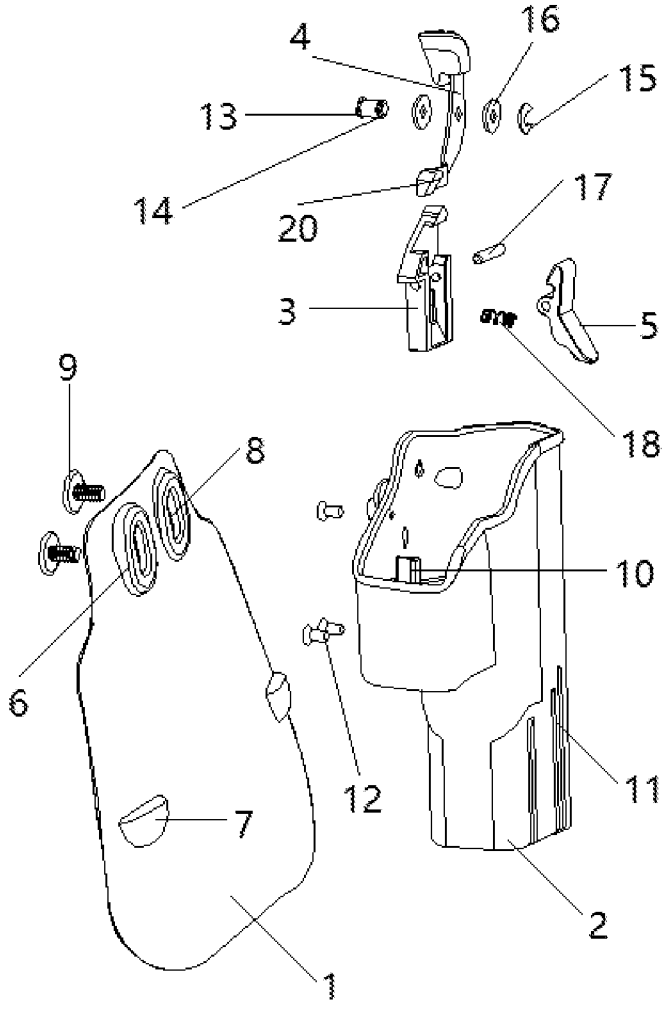
FIG. 4 is a schematic structural view of components of the present invention.

Referring to FIGS. 1 to 4, the present invention provides a technical solution, comprising: a waist protection plate 1, a holster body 2 disposed at one side of the waist protection plate 1, a positioning supporting plate 3 disposed above the holster body 2 and at a side close to the waist protection plate 1, an L-shaped connecting piece 4 disposed above the positioning supporting plate 3, and a positioning supporting clamp 5 disposed at one side of the positioning supporting plate 3.

An overall structure of the waist protection plate 1 is a cambered surface, and the waist protection plate 1 of the cambered-surface structure is used for fitting the body. Two fastener link platforms 6 are arranged above the waist protection plate 1, positioning bosses 7 are arranged at both sides of a middle part of the waist protection plate 1, and an outer side of the positioning boss 7 and an outer side of the fastener link platform 6 are disposed in the same vertical plane, which facilitates vertical arrangement of the holster body 2, and avoids the trouble that a gun is easy to drop due to inclination. A bolt hole 8 is opened at a middle part of the fastener link platform 6, a primary screw 9 is connected inside the bolt hole 8, and the waist protection plate 1 is fastened with the holster body 2 via the primary screw 9.

The holster body 2 is a cavity structure matching a gun, a fixing platform 10 in pressing connection for unholstering is disposed at a middle part of a lateral side of the holster body 2, decorative lines 11 are arranged at a periphery of a lower part of the holster body 2, several secondary screws 12 are connected at one side of the holster body 2, and the holster body 2 is fastened with the positioning supporting plate 3 via the secondary screws 12.

A positioning column 13 is fixedly disposed at one side of an upper part of the positioning supporting plate 3, the positioning supporting plate 13 is hinged with the L-shaped connecting piece 4 through the positioning column 13, a clamping slot 14 is arranged at a top end of the positioning column 13, an E-shaped washer 15 rotatable around the clamping slot 14 is connected to the positioning column 13 through the clamping slot 14, and gaskets 16 are disposed between the positioning column 13 and the L-shaped connecting piece 4 and between the E-shaped washer 15 and the L-shaped connecting piece 4. The positioning column 13 fixes and tightly locks the L-shaped connecting piece 4 with the holster body 2 by inserting the gaskets 16 and the E-shaped washer 15 into the clamping slot 14.

A pin 17 is fixedly disposed at one side below the positioning supporting plate 3, the positioning supporting plate 3 is hinged with the positioning supporting clamp 5 via the pin 17, and the position of the positioning supporting clamp 5 corresponds to the position of a trigger guard ring after a gun is placed in the holster body 2. A return spring 18 is mounted between the positioning supporting clamp 5 and the positioning supporting plate 3. The return spring 18 is used for providing preload to the positioning supporting clamp 5, such that the positioning supporting clamp 5 limits the trigger guard ring.

A pressing member 19 is arranged at a top end of the L-shaped connecting piece 4, a supporting block 20 matching a top end of the positioning supporting clamp 5 is disposed at a bottom end of the L-shaped connecting piece 4, and the L-shaped connecting piece 4 and the positioning supporting clamp 5 cooperate with each other in space according to a lever principle. An overall trigger mechanical structure is simple, low in failure rate and relatively reliable in actual applications.

Anti-skid bumps 21 in rectangular arrangement are uniformly arranged on an upper surface of the pressing member 19, the pressing member 19 is of an upward protruding structure, and the upper surface of the pressing member 19 has an area of 2-5 $cm^2$.

A main body of the pressing member 19 matches an upper edge of the waist protection plate 1, and the pressing member 19 employs a transverse pressing mode. The pressing member 19 is disposed at a side close to the waist protection plate 1 and therefore not easily touched by an external force, thus preventing a gun from missing, theft or robbery, and providing reliable protection.

Due to a spatial structure of the pressing member 19, the triggering mode is set to be pressing and pushing with a thumb. The triggering mode of pressing and pushing the pressing member 19 with a thumb can be simultaneously performed with the action of unholstering, thus improving the speed of unholstering, such that a gun can be drawn quickly.

Embodiment 1

Generally, when a gun is carried, the gun is placed in the holster body 2, the trigger guard ring of the gun presses down the positioning supporting clamp 5, and the positioning supporting clamp 5 rotates by a certain angle around the pin 17 of the positioning supporting plate 3 to press down the return spring 18. The top end of the positioning supporting clamp 5 is in contact with the supporting block 20 at the bottom end of the L-shaped connecting piece 4. The L-shaped connecting piece 4 and the positioning supporting clamp 5 cooperate with each other in space according to the lever principle, such that the L-shaped connecting piece 4 rotates by a certain angle around the positioning column 13 on the positioning supporting plate 3. After the gun is in place, the positioning supporting clamp 5 returns to its original position under the pressure of the return spring 18, and meanwhile, the L-shaped connecting piece 4 also returns to its original position. The positioning supporting clamp 5 limits the trigger guard ring, and the E-shaped washer 15 is rotated to increase a damping force between the L-shaped connecting piece 4 and the gasket 16 to facilitate locking, such that the pressing member is not easily touched by an external force, thus preventing the gun from missing, theft or robbery, and providing reliable protection.

Embodiment 2

While on assignment, firstly, the E-shaped washer 15 is rotated to reduce the damping force between the L-shaped connecting piece 4 and the gasket 16 to facilitate use of the gun. The pressing member 19 employs a transverse pressing mode. The pressing member 19 is disposed at a side close to the waist protection plate 1 and therefore not easily touched by an external force, thus preventing the gun from missing, theft or robbery. When the gun is needed, the pressing member 19 is pushed with a thumb, and the L-shaped connecting piece 4 rotates by a certain angle around the positioning column 13 on the positioning supporting plate 3. The L-shaped connecting piece 4 and the positioning supporting clamp 5 cooperate with each other in space according to the lever principle. The supporting block 20 at the bottom end of the L-shaped connecting piece 4 pushes the positioning supporting clamp 5, and one side of the positioning supporting clamp 5 is lowered and leaves the trigger guard ring. While the pressing member 19 is pushed with a thumb, a handle of the gun is held to draw the gun. Due to the spatial structure of the pressing member 19, the triggering mode is set to be pressing and pushing with a thumb. The triggering mode of pressing and pushing the pressing member 19 with a thumb can be simultaneously performed with the action of unholstering, thus improving the speed of unholstering, such that the gun can be drawn quickly.

Although the embodiments of the present invention have been disclosed above, the present invention is not limited to applications listed in the description and the detailed description, but can be absolutely applied to various fields suitable for the present invention. For persons skilled in the art and for persons of ordinary skill in the art, various changes, modifications, replacements and variations can be made to these embodiments without departing from the principle and spirit of the present invention. Therefore, within the general concept defined by the claims and the equivalent scope, the present invention is not limited to particular details and figure legends shown and described herein.

The invention claimed is:

1. A holster with a protection mechanism that facilitates holstering and unholstering and protects against theft and robbery, comprising:

a waist protection plate (1), a holster body (2) disposed at one side of the waist protection plate (1), wherein the holster body is a tubular structure that includes an opening end configured to receive a firearm, a positioning supporting plate (3) disposed at the opening end of the holster body (2) and at a side close to the waist protection plate (1), an L-shaped connecting piece (4) attached to the positioning supporting plate (3), and a positioning supporting clamp (5) disposed at one side of the positioning supporting plate (3).

2. The holster with a protection mechanism that facilitates holstering and unholstering and protects against theft and robbery according to claim 1, wherein an overall structure of the waist protection plate (1) is a cambered surface, two fastener link platforms (6) are arranged at one end of the waist protection plate (1), positioning bosses (7) are arranged at both sides of a middle part of the waist protection plate (1), an outer side of the positioning boss (7) and an outer side of the fastener link platform (6) are disposed in the same vertical plane, a bolt hole (8) is opened at a middle part of the fastener link platform (6), a primary screw (9) is connected inside the bolt hole (8), and the waist protection plate (1) is fastened with the holster body (2) via the primary screw (9).

3. The holster with a protection mechanism that facilitates holstering and unholstering and protects against theft and robbery according to claim 1, wherein the holster body (2) is a cavity structure matching a gun, a fixing platform (10) in pressing connection for unholstering is disposed at a middle part of a lateral side of the holster body (2), decorative lines (11) are arranged at a periphery of a lower part of the holster body (2), several secondary screws (12) are connected at one side of the holster body (2), and the holster body (2) is fastened with the positioning supporting plate (3) via the secondary screws (12).

4. The holster with a protection mechanism that facilitates holstering and unholstering and protects against theft and robbery according to claim 1, wherein a positioning column (13) is fixedly disposed at one side of an upper part of the positioning supporting plate (3), the positioning supporting plate (3) is hinged with the L-shaped connecting piece (4) through the positioning column (13), a clamping slot (14) is arranged at a top end of the positioning column (13), an E-shaped washer (15) rotatable around the clamping slot (14) is connected to the positioning column (13) through the clamping slot (14), and gaskets (16) are disposed between the positioning column (13) and the L-shaped connecting piece (4) and between the E-shaped washer (15) and the L-shaped connecting piece (4).

5. The holster with a protection mechanism that facilitates holstering and unholstering and protects against theft and robbery according to claim 1, wherein a pin (17) is fixedly attached to the positioning supporting plate (3), the positioning supporting plate (3) is hinged with the positioning supporting clamp (5) via the pin (17), and a return spring (18) is mounted between the positioning supporting clamp (5) and the positioning supporting plate (3).

6. The holster with a protection mechanism that facilitates holstering and unholstering and protects against theft and robbery according to claim 1, wherein a pressing member (19) is arranged at a top end of the L-shaped connecting piece (4), a supporting block (20) matching a top end of the positioning supporting clamp (5) is disposed at a bottom end of the L-shaped connecting piece (4), and the L-shaped connecting piece (4) and the positioning supporting clamp (5) cooperate with each other in space according to a lever principle.

7. The holster with a protection mechanism that facilitates holstering and unholstering and protects against theft and robbery according to claim 6, wherein anti-skid bumps (21) in rectangular arrangement are uniformly arranged on an upper surface of the pressing member (19), the pressing member (19) is of an upward protruding structure, and the upper surface of the pressing member (19) has an area of 2-5 $cm^2$.

8. The holster with a protection mechanism that facilitates holstering and unholstering and protects against theft and robbery according to claim 7, wherein a main body of the pressing member (19) matches an upper edge of the waist protection plate (1), and the pressing member (19) employs a transverse pressing mode.

9. The holster with a protection mechanism that facilitates holstering and unholstering and protects against theft and robbery according to claim 1, wherein the position of the positioning supporting clamp (5) corresponds to the position of a trigger guard ring after a gun is placed in the holster body (2).

* * * * *